US010401097B2

(12) United States Patent
Rouhana

(10) Patent No.: US 10,401,097 B2
(45) Date of Patent: Sep. 3, 2019

(54) HEAT EXCHANGER

(71) Applicant: MAHLE International GmbH, Stuttgart (DE)

(72) Inventor: Hicham Rouhana, Korntal-Muenchingen (DE)

(73) Assignee: MAHLE International GmbH, Stuttgart (DE)

( * ) Notice: Subject to any disclaimer, the term of this patent is extended or adjusted under 35 U.S.C. 154(b) by 165 days.

(21) Appl. No.: 14/678,538

(22) Filed: Apr. 3, 2015

(65) Prior Publication Data

US 2015/0285571 A1 Oct. 8, 2015

(30) Foreign Application Priority Data

Apr. 4, 2014 (DE) ..... 10 2014 206 612

(51) Int. Cl.
*F28F 9/02* (2006.01)
*F28D 1/047* (2006.01)
(Continued)

(52) U.S. Cl.
CPC ..... *F28F 9/0229* (2013.01); *F28D 1/0476* (2013.01); *F28D 1/05366* (2013.01);
(Continued)

(58) Field of Classification Search
CPC ..... F28D 1/0471; F28D 1/047; F28D 1/0473; F28D 1/0476; F28D 1/0478; F28D 1/0535; F28D 7/1684; F28D 15/0233; F28F 1/06; F28F 1/08; F28F 1/10; F28F 1/32; B01D 19/0094; B01J 19/10; B01J 2219/00139; B01J 2219/187; B01J 2219/1941; B06B 3/04
See application file for complete search history.

(56) References Cited

U.S. PATENT DOCUMENTS 2,105,267 A * 1/1938 Hogg ..... B64D 33/10 165/148
2,151,540 A * 3/1939 Varga ..... F28F 3/02 138/117
(Continued)

FOREIGN PATENT DOCUMENTS

CN 1531641 A 9/2004
CN 102959353 A 3/2013
(Continued)

OTHER PUBLICATIONS

Chinese Office Action for Chinese Application No. 201510155420.1 dated Jan. 2, 2018 with English translation.

*Primary Examiner* — Devon Russell
*Assistant Examiner* — Melodee Jefferson
(74) *Attorney, Agent, or Firm* — Muncy, Geissler, Olds & Lowe, P.C.

(57) ABSTRACT

A heat exchanger having at least one collecting tank with a plurality of tube openings and with a tube bundle of tubes, whereby the ends of the tubes engage in openings of the collecting tank, whereby the tubes have a broad side with the length L with opposite tube side walls and two narrow sides at the ends with the width B each with a tube wall arc, whereby the tube wall arc has a diameter that is greater than the distance of the opposite tube side walls.

9 Claims, 2 Drawing Sheets

(51) Int. Cl.
*F28D 1/053* (2006.01)
*F28F 1/02* (2006.01)
*F28F 9/18* (2006.01)

(52) U.S. Cl.
CPC ..... *F28F 1/02* (2013.01); *F28F 9/0224* (2013.01); *F28F 9/182* (2013.01)

(56) References Cited

U.S. PATENT DOCUMENTS 3,016,230 A * 1/1962 Cederstrom ..... F28F 1/025 126/91 R
3,364,951 A * 1/1968 Burne ..... B21D 53/06 138/38
3,964,873 A * 6/1976 Aramaki ..... C10G 9/20 122/235.14
4,206,806 A * 6/1980 Togashi ..... F28F 9/0221 165/175
4,269,267 A * 5/1981 Labrande ..... B21C 37/22 165/181
4,327,800 A * 5/1982 Miller ..... F28F 1/32 165/151
4,369,837 A * 1/1983 Moranne ..... B21D 41/04 165/175
5,178,124 A * 1/1993 Lu ..... F24H 3/105 126/110 R
5,186,250 A * 2/1993 Ouchi ..... F28D 1/0316 165/152
5,271,151 A * 12/1993 Wallis ..... B21C 37/14 29/890.053
5,299,636 A * 4/1994 Potier ..... F28F 9/14 165/173
5,301,748 A * 4/1994 Potier ..... F28F 9/14 165/173
5,329,990 A * 7/1994 Chigira ..... F28D 1/05383 165/153
5,531,268 A 7/1996 Hoshino et al.
5,839,505 A * 11/1998 Ludwig ..... F28D 1/0477 138/38
6,523,606 B1 * 2/2003 Dienhart ..... F28D 1/05391 165/144
6,546,999 B1 * 4/2003 Dienhart ..... F28D 1/0476 165/150
6,843,097 B2 1/2005 Tatsuta et al.
6,899,168 B2 * 5/2005 Ghiani ..... F28D 1/0408 165/148
7,559,355 B2 * 7/2009 Oh ..... F28F 1/022 138/115
2001/0037878 A1 * 11/2001 Brost ..... F28D 1/05366 165/175
2001/0047859 A1 * 12/2001 Ishida ..... B21C 37/151 165/104.14
2002/0134537 A1 * 9/2002 Memory ..... B21D 53/085 165/151
2002/0149202 A1 * 10/2002 Tatsuta ..... B21D 41/02 285/416
2003/0111212 A1 * 6/2003 Takamizawa ..... F28D 15/0266 165/104.21
2003/0141048 A1 * 7/2003 Lee ..... F28D 1/05383 165/177
2003/0183378 A1 * 10/2003 Memory ..... F28D 1/0476 165/153
2004/0070291 A1 * 4/2004 Chan ..... F28D 1/047 310/64
2005/0006079 A1 * 1/2005 Ishii ..... B21D 53/085 165/173
2005/0061494 A1 * 3/2005 Tsuji ..... B21D 39/06 165/173
2005/0077035 A1 * 4/2005 Lamich ..... F28D 1/0535 165/175
2005/0092444 A1 * 5/2005 Kohlgruber ..... B01D 1/06 159/2.1
2005/0161206 A1 * 7/2005 Ambros ..... F02B 29/0462 165/173
2006/0118288 A1 * 6/2006 Oh ..... F28F 1/022 165/177
2006/0201663 A1 * 9/2006 Strahle ..... F28D 9/0031 165/164
2006/0269458 A1 * 11/2006 Phillips ..... B01D 19/0094 422/128
2007/0114013 A1 * 5/2007 Augenstein ..... F28F 9/02 165/174
2007/0178029 A1 * 8/2007 Goebbel ..... B01J 8/067 422/227
2008/0029243 A1 * 2/2008 O'Donnell ..... F24H 3/087 165/48.1
2008/0135220 A1 * 6/2008 Aksoy ..... F28F 9/0224 165/157
2008/0230213 A1 * 9/2008 Roll ..... B21D 53/08 165/173
2009/0025916 A1 * 1/2009 Meshenky ..... B21D 13/08 165/151
2009/0126919 A1 * 5/2009 Bensel ..... B23P 15/26 165/173
2010/0051247 A1 3/2010 Sogabe et al.
2011/0169263 A1 * 7/2011 Bazika ..... B29C 66/91431 285/293.1
2012/0031601 A1 * 2/2012 Matter, III ..... F28D 1/05383 165/177
2012/0211495 A1 * 8/2012 Hirsch ..... F28F 9/0224 220/565
2013/0146267 A1 * 6/2013 Garret ..... F28D 7/1684 165/175
2014/0083665 A1 * 3/2014 Feuerecker ..... F28F 9/0209 165/173
2014/0090823 A1 * 4/2014 Moser ..... F28F 9/00 165/169

FOREIGN PATENT DOCUMENTS

CN 203375868 U 1/2014
DE 28 39 142 A1 3/1979
DE 694 15 779 T2 5/1999
EP 0 692 692 A1 1/1996
EP 1420222 A1 * 5/2004 ..... F28D 1/05391
FR 2 475 709 A1 8/1981
FR 2 866 948 A1 9/2005
FR 2 909 912 A1 6/2008

* cited by examiner

HEAT EXCHANGER

This nonprovisional application claims priority under 35 U.S.C. § 119(a) to German Patent Application No. 10 2014 206 612.3, which was filed in Germany on Apr. 4, 2014, and which is herein incorporated by reference.

BACKGROUND OF THE INVENTION

Field of the Invention

The present invention relates to a heat exchanger, particularly for motor vehicles.

Description of the Background Art

Heat exchangers are sufficiently known from the conventional art. In this regard, tube bundles of flat tubes are usually provided, whereby the tube ends extend through openings into a collecting tank and are there soldered to the collecting tank. Cracks, therefore failures, occur in the area of the tube/tank connection with thermal cycling or in the case of thermal stress due to tension/compression. It becomes apparent that the failures usually occur on the narrow side of the tube at the tube/tank connection.

DE 2839142, which corresponds to U.S. Pat. No. 4,269,267, provides that oval tubes are used in a heat exchanger, whereby the long tube side walls are braced elastically and thereby form an inwardly curved concave side wall.

SUMMARY OF THE INVENTION

It is therefore an object of the present invention to provide a heat exchanger that is improved in particular in regard to requirements in the case of thermal cycling.

An exemplary embodiment of the invention relates to a heat exchanger having at least one collecting tank with a plurality of tube openings and with a tube bundle of tubes, whereby the ends of the tubes engage in openings of the collecting tank, whereby the tubes have a broad side with the length $L_1$ with opposite tube side walls and two narrow sides at the ends with the width $l_0$ each with a tube wall arc, whereby the tube wall arc has a diameter $l_1$ that is greater than the distance of the opposite tube side walls. As a result, a greater area that can be soldered is available on the narrow sides of the tube in the area of the tube-opening connection, so that a more stable connection is produced which is more stable in particular during thermal cycling as well.

The tube wall arc can have a circle segment-like contour. The pressure stability is increased thereby and the solderable area on the narrow side is increased simultaneously, which improves the stability of the soldering.

The tube wall arc can have a diameter $l_1$ that is greater by at least 10%, preferably by more than 15%, or more than the distance $l_0$ of the opposite tube side walls. As a result, an area for soldering is provided that leads to a considerable increase in stability.

The openings of the collecting tank can have the same contour as the contour of the tube. As a result, the opening as well has an approximately bone-shaped contour, with an elongated middle part and circular end regions.

Two collecting tanks can be provided, whereby each tube end engages in one opening each of one of the two collecting tanks. Alternatively, it is advantageous if one collecting tank is provided, whereby the tubes are made bent in such a way that each tube end of a tube engages in one opening each of the one collecting tank.

To improve the tube-opening connection, the openings of the collecting tank or collecting tanks can have an upright rim as a rim hole, which is directed inward into the collecting tank or outward away from the collecting tank. As a result, the solderable area is increased, which in turn improves the stability of the connection between the tube and opening.

The tube side walls of a tube can be arranged substantially parallel to one another. This leads to an improved manufacturability, because the contour can be easily calibrated.

The collecting tank can have a tube sheet and a tank cover, whereby the openings are introduced in the tube sheet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
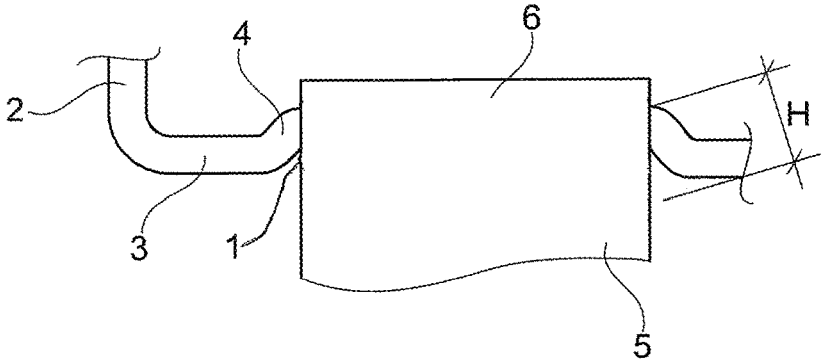
FIG. 1 shows a schematic view of an opening of a collecting tank with a circumferential, upright rim as a rim hole with a removed tube end.

FIG. 1 shows a schematic view of an opening 1 of a collecting tank 2, preferably in a tube sheet 3 of collecting tank 2, whereby the opening has a preferably circumferential, upright rim 4 as a rim hole. A tube 5 is inserted with its tube end 6 in said opening 1 and soldered with the upright rim 4. Rim 4 in this case has approximately the height H. Rim 4 or the rim hole in this case can both project into collecting tank 2 and also alternatively project away from the interior of collecting tank 2, therefore in the direction of the tube bundle.

Figure 2:
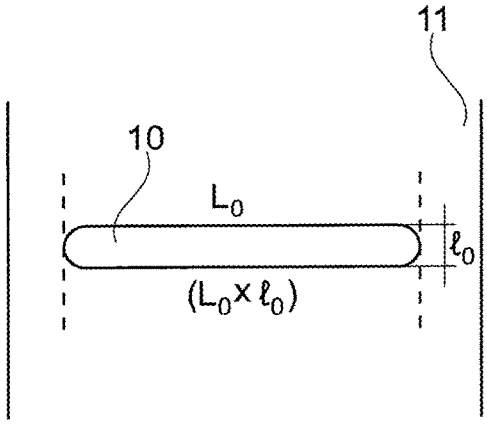
Fig. 2 (Prior Art)
FIG. 2 shows a schematic view of an opening of a collecting tank according to the conventional art.

FIG. 2 shows a schematic view of an opening 10 in a collecting tank 11 according to the state of the art. The contour of the opening corresponds to the contour of a flat tube with a substantially rectangular cross-sectional area with a broad side with the length $L_0$ and a narrow side with the width $l_0$. The contour is rounded on the narrow sides. The cross-sectional area in this case is approximately $L_0 * l_0$.

Figure 3:
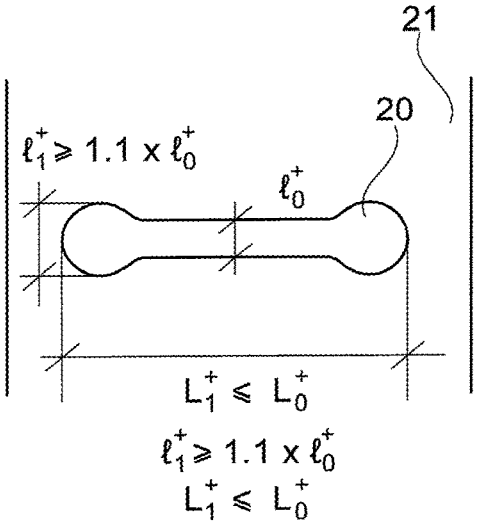
FIG. 3 shows a schematic view of an opening of a collecting tank according to an embodiment of the invention.

FIG. 3 shows a schematic view of an opening 20 in a collecting tank 21 according to the invention. The contour of the opening corresponds to the contour of a flat tube with a substantially rectangular cross-sectional area with a broad side with the length $L_1$ and a narrow side with the width $l_0$, in which further on the narrow sides a tube wall arc is provided, which has a diameter $l_1$, which is larger than the width $l_0$ in the middle area of the opening. In this case, $l_1$ is preferably greater than or equal to $1.1*l_0$. Alternatively, it is advantageous if $l_1>1.15*l_0$ or greater.

In this case, it is preferable, if the length $L_1$ of opening 20 is smaller than or equal to the length of the opening $L_0$ according to the state of the art, so that the cross-sectional area of opening 20 is greater than or equal to the cross-sectional area of tube 10.

The shown opening has the illustrated contour, whereby the employed tube has the same contour as the contour of the opening. This results in a larger contact surface between the opening and tube, so that a larger area is connected together during soldering and a more stable connection is produced thereby. Tubes 33, 42 in this case have a broad side with the length $L_1$ with opposite tube side walls and two narrow sides at the ends with the width lo each with a tube wall arc, whereby the tube wall arc has a diameter $l_1$ that is greater than the distance $l_0$ of the opposite tube side walls. The tube wall arc thereby has a circle segment-like contour. In this case, the tube wall arc has a diameter $l_1$ that is greater than the distance $l_0$ of the opposite tube side walls by 10%, preferably by 15% or more, or equal thereto, so that the following applies: $l_1>1.1*l_0$ or $l_1>1.15*l_0$.

The tubes therefore at their side rim areas, at the narrow sides, experience a widening, which is made arc-shaped, circular arc-shaped, or circle segment-shaped and which has a diameter that is greater than the width of the tube in the middle area. The tube is thereby widened approximately in the shape of a bone. In this case, this widening can be present only at the tube end that is inserted in the opening or, alternatively, the widening can be present over the entire length of the tube.

Figure 4:
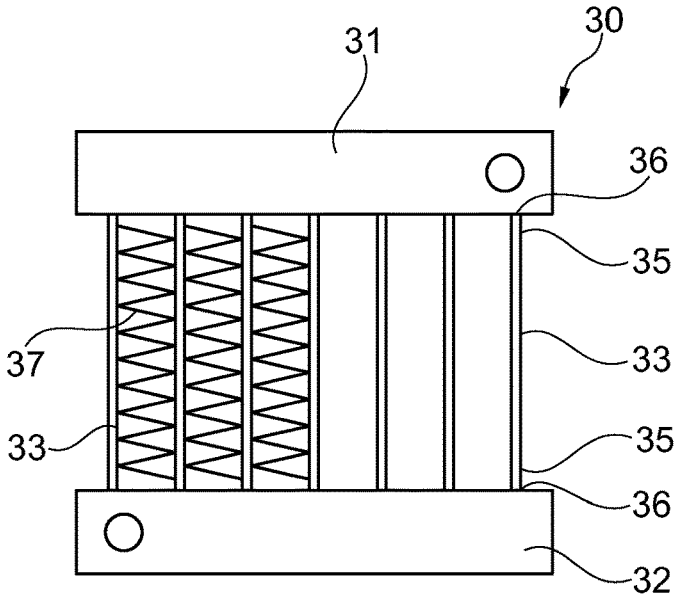
FIG. 4 shows a schematic view of a heat exchanger with collecting tanks and tubes.
Figure 5:
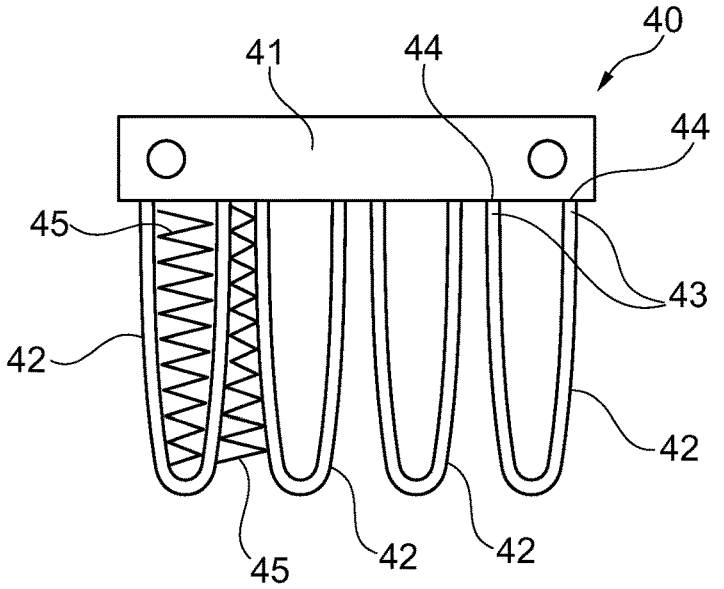
FIG. 5 shows a schematic view of an alternative heat exchanger with collecting tanks and tubes.

FIGS. 4 and 5 show alternative designs of heat exchangers 30, 40. In this case, in FIG. 4 a heat exchanger 30 with two collecting tanks 31, 32 is shown, whereby each tube 33 with its two tube ends 35 is arranged in such a way that in each case one tube end 35 engages in one opening 36 each in one of the two collecting tanks 31, 32.

Alternatively, in FIG. 5 a heat exchanger 40 with only one collecting tank 41 is shown, whereby each tube 42 with its two tube ends 43 is shaped and arranged in such a way that in each case one tube end 43 engages in one opening 44 each of the same collecting tank 41. At least one partition wall, which is not shown here, however, is provided for fluid separation in a conventional manner in collecting tank 41. In this regard, a redirection in width or depth or combinations thereof can be realized depending on the design of tubes 42.

Furthermore, corrugated fins 37, 45 may be provided between the tubes.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising:

at least one collecting tank with a plurality of tube openings; and a tube bundle of tubes, ends of the tubes being inserted in the plurality of tube openings of the at least one collecting tank, the ends of the tubes each having a broad side, formed by two opposite tube side walls, the two opposite tube side walls being connected together by a first narrow side and a second narrow side, the first and second narrow sides each formed by a tube wall arc, such that a contour of the ends of the tubes includes the two opposite tube side walls and the first and second narrow sides each formed by the respective tube wall arc, the contour of the ends of the tubes being the same as a contour of each of the plurality of tube openings of the at least one collecting tank;

wherein the tube wall arc of each of the first narrow side and the second narrow side has a diameter that is greater than a distance between the two opposite tube side walls of the broad side and the center of the arc diameter is not located between the two opposite tube side walls;

wherein the two opposite tube side walls are parallel to each other and are each formed as a straight wall that extends from the tube wall arc of the first narrow side to the tube wall arc of the second narrow side; and wherein each of the tubes has the same cross-sectional shape along its entire length.

2. The heat exchanger according to claim 1, wherein the diameter of the tube wall arc of each of the first narrow side and the second narrow side is greater than the distance between the two opposite tube side walls by at least 10%.

3. The heat exchanger according to claim 1, wherein the plurality of tube openings of the at least one collecting tank have the same contour as the contour of the tube.

4. The heat exchanger according to claim 1, further comprising two of the at least one collecting tank, such that the heat exchanger includes two collecting tanks, wherein each tube end respectively engages in one of the plurality of tube openings of one of the two collecting tanks.

5. The heat exchanger according to claim 1, wherein one of the at least one collecting tank is provided, wherein the tubes are formed bent or shaped such that each tube end of a tube respectively engages in one of the plurality of tube openings of the one of the at least one collecting tank.

6. The heat exchanger according to claim 1, wherein the plurality of tube openings of the at least one collecting tank have an upright rim, which is directed inward into the at least one collecting tank or outward away from the at least one collecting tank.

7. The heat exchanger according to claim 1, wherein the at least one collecting tank has a tube sheet, and wherein the plurality of tube openings are introduced in the tube sheet.

8. The heat exchanger according to claim 1, wherein a length of the two opposite tube side walls is greater than the diameter of the tube wall arc of each of the first narrow side and the second narrow side.

9. The heat exchanger according to claim 1, wherein the straight wall forming a first one of the two opposite tube side walls and the straight wall forming a second one of the two opposite tube side walls each extend straight continuously from the tube wall arc of the first narrow side to the tube wall arc of the second narrow side.

* * * * *